United States Patent [19]

Straitz, III

[11] 3,994,671

[45] Nov. 30, 1976

[54] FLARE GAS BURNER

[75] Inventor: John F. Straitz, III, Meadowbrook, Pa.

[73] Assignee: Combustion Unlimited Incorporated, Elkins Park, Pa.

[22] Filed: Jan. 14, 1976

[21] Appl. No.: 648,877

Related U.S. Application Data

[63] Continuation-in-part of Ser. No. 558,283, March 14, 1975.

[52] U.S. Cl. ..... 431/202; 23/277 C; 431/4; 431/5; 431/114

[51] Int. Cl.[2] ..... F23B 5/00

[58] Field of Search ..... 431/4, 5, 202, 114, 431/190; 23/277 C; 239/403, 405

[56] References Cited

UNITED STATES PATENTS

| | | | |
|---|---|---|---|
| 2,506,972 | 5/1950 | Schellentrager et al. | 431/202 |
| 2,779,399 | 1/1957 | Zink et al. | 431/202 |
| 2,964,121 | 12/1960 | Zink et al. | 431/114 |
| 3,547,567 | 12/1970 | Turpin | 431/202 |
| 3,730,673 | 5/1973 | Straitz | 431/202 |
| 3,822,984 | 7/1974 | Straitz | 431/283 |

*Primary Examiner*—Edward G. Favors
*Attorney, Agent, or Firm*—Z. T. Wobensmith, 2nd; Z. T. Wobensmith, III

[57] ABSTRACT

A flare gas burner is described for the smokeless combustion of flare gas at low noise level with the flare gas delivered in a hollow whirling path for burning, ignited and burned with air and steam delivered interiorly and exteriorly, also in whirling paths intersecting or overlapping the delivered flare gas, additional steam being supplied at the outer margin of the outer air path, a diffuser being provided for the interior air and steam. The structure is also provided with a diode in the gas path to prevent flashback and with accoustically lined baffling to reduce noise.

9 Claims, 5 Drawing Figures

Fig. 2.
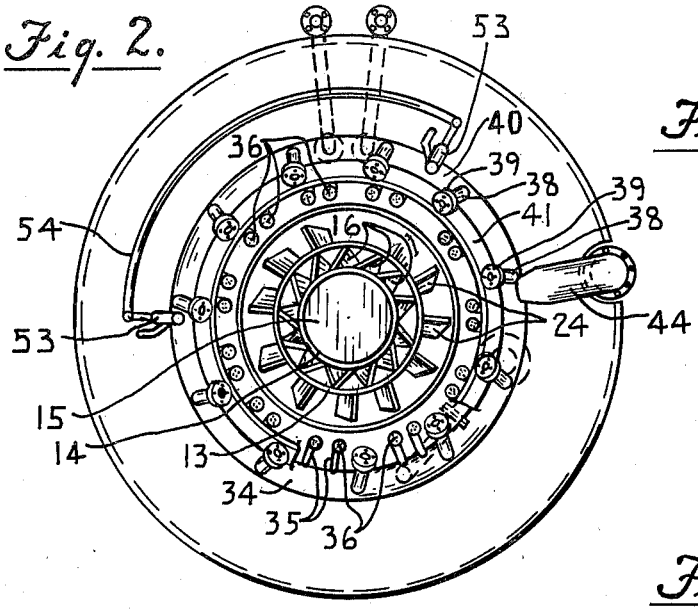
Fig. 3.
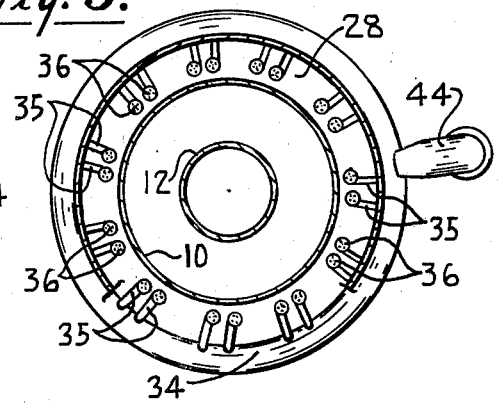
Fig. 4.
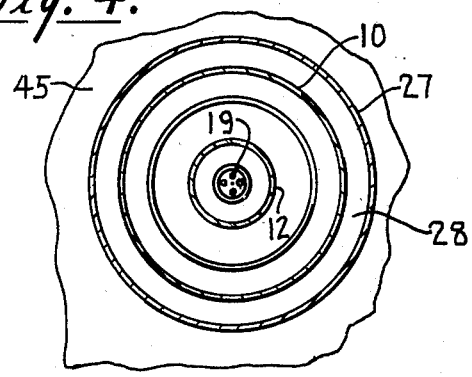
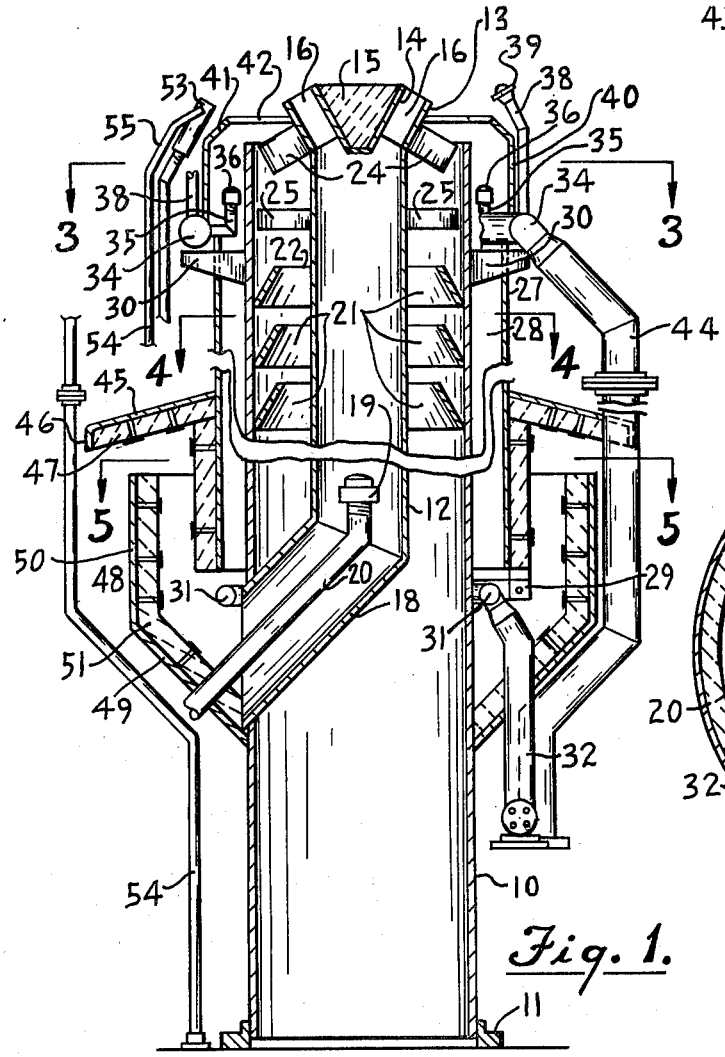
Fig. 1.
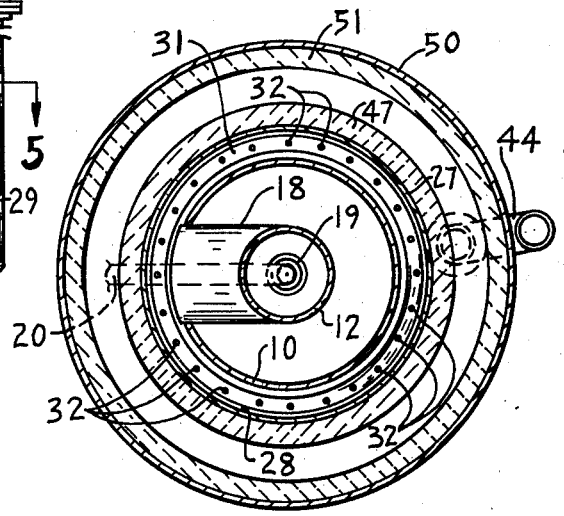
Fig. 5.

FLARE GAS BURNER

CROSS REFERENCE TO RELATED APPLICATION

This application is a continuation in part of my prior application for patent for Flare Gas Burner, filed Mar. 14, 1975, Ser. No. 558,283.

BACKGROUND OF THE INVENTION

1. Field of the Invention

This invention relates to a flare gas burner of the smokeless type which uses steam and air for smoke suppression and utilizes baffling lined with noise absorbing material to reduce noise.

2. Description of the Prior Art

There have been many flare gas burners developed which use steam to improve combustion and to suppress smoke. Example of such burners are shown in my prior U.S. Pat. No. 3,822,984 and in the patent to Zink et al., U.S. Pat. No. 3,512,911.

In flares for smokeless burning of waste gas there are two primary sources of noize to consider. The first noise source depends on the combustion of the gas and its burning rate.

The turbulence from mixing the gas with air and steam necessary for smokeless burning produces an increased burning rate with resultant increase of noise. With little mixing the noise level is low, but there is a greater likelihood of smoke due to poor combustion with the result that a compromise is necessary and this may not result in the most complete combustion.

The other primary source of noise is high velocity or jet noise resulting from the flow of steam which is greater when an outer steam ring is used but which is present whenever steam is used for aiding combustion and smoke suppression.

The apparatus heretofore available, being a compromise may not perform satisfactorily in areas which are congested and where noise becomes a factor to be considered from the viewpoint of satisfying neighbors and government noise level codes.

In my prior application for Flare Gas Burner, filed Mar. 14, 1975, Ser. No. 558,283, a burner is disclosed which is effective for operation without smoke and at acceptable levels of noise emission. The present invention involves refinements over the structure there disclosed and is suitable for burning larger quantities of waste gas without smoke and quietly.

SUMMARY OF THE INVENTION

In accordance with the invention a flare gas burner for smokeless combustion at low noise level is provided which has a stack with flare gas introduced thereinto at the bottom, with fixed vanes at the top of the pipe angularly disposed in a horizontal plane for vortex discharge of the gas, the stack also having inner and outer air and steam passageways with the fluid in the inner passageway directed by fixed vanes and a diffuser within the burning flare gas stream and the air and steam in the outer passageway being supplemented and directed in a whirling path around the exterior of the burning flare gas in a vortex path by steam jets. The flare gas is prevented from backflashing by a diode in the gas path in the stack and accoustical baffling is provided to reduce the exterior noise levels. Igniters and pilots are also provided.

It is the principal object of the invention to provide a flare gas burner that operates at a high combustion efficiency and at acceptable noise levels.

It is a further object of the invention to provide a flare gas burner which is sturdy and simple to construct and requires a minimum of maintenance.

It is a further object of the invention to provide a flare gas burner which can smokelessly and quietly burn flare gases of varying compositions at varying flow rates and at high flow rates.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 1 is a vertical central sectional view of the flare gas burner in accordance with the invention;

FIG. 2 is a top plan view of the flare gas burner shown in FIG. 1;

FIG. 3 is a horizontal sectional view taken approximately on the line 3—3 of FIG. 2;

FIG. 4 is a horizontal sectional view taken approximately on the line 4—4 of FIG. 2; and FIG. 5 is a horizontal sectional view taken approximately on the line 5—5 of FIG. 2.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, the flare gas burner of my invention includes a vertical stack pipe 10 with a flange connection 11 at its bottom for connection to a source of flare or dump gas (not shown) to be burned. The pipe 10 has a vertical pipe 12 concentrically disposed therein of smaller diameter which is provided at the top with an inserted bell shaped or flaring frusto-conical outlet section 13 spaced from a diffuser 14 which may have a ceramic refractory filling 15 to withstand the heat at this location and prevent the collection of rain water.

The outlet pipe 13 and diffuser 14 have a plurality of vanes 16 connected thereto as by welding, and tilted with respect to the vertical and offset from or at an angle to radii through the vertical central axis of the diffuser 14 and pipe 12 to impart a swirling or rising rotary vortex motion to the air moving upwardly therethrough.

The pipe 12 has an upwardly inclined extension 18 communicating with the atmosphere exteriorly of the pipe 10 for entry of air. In order to induce air for delivery through the extension 18 and upwardly through the pipe 12 a steam nozzle 19 can be provided to which steam is supplied by a steam supply pipe 20.

Within the stack pipe 10, near the top thereof, diodes 21 are provided to prevent downflow of air in the pipe 10 these preferably being vertically spaced frusto-conical baffles with aligned central openings 22.

At the upper end of the pipe 12 and preferably carried by the outlet section 13 a plurality of vanes 24 are provided tilted with respect to the vertical and offset from or at an angle to radii through the vertical central axis of the pipe 12.

Stiffener braces 25 radially disposed and connecting the pipes 10 and 12 can be provided at desired levels.

In surrounding relation and concentric relation to the pipe 10 and spaced outwardly therefrom a pipe 27 is provided terminating contiguous to the upper end of the pipe 12 for upward delivery of air for combustion in a space 28.

At the lower end of the pipe 27 a ring manifold 31 is provided supported from the pipe 27 by brackets 29 and is provided with upwardly directed orifices 32 for inducing air upwardly within the space 28. The ring manifold 31 has a steam supply pipe 33 connected thereto.

Below the upper end of the pipe 27 a ring manifold 34 is provided, supported by brackets 30 extending outwardly from the pipe 10 and having a plurality of nozzle supply pipes 35 connected thereto, the pipes 35 having upwardly and outwardly discharging steam nozzles 36 on their upper ends. The nozzles 36 are disposed at an angle to the vertical to provide a vortex path to aid in advancing air from the space 28 for combustion.

The ring manifold 34 also has a plurality of nozzle supply pipes 38 connected thereto and extending upwadly and at angle to the vertical with nozzles 39 thereon to impart a vortex path to the air and to induce surrounding air into the contact with the burning gases.

Within the pipes 38 a guide ring 40 is provided having a converging wall section 41 and end opening 42 for directing air from space 28 inwardly toward the outwardly and conically directed gas steam directed by the vanes 24.

The ring manifold 34 has a steam supply pipe 44 connected thereto.

The pipe 27, at the lower part thereof, has a frustoconical shroud plate 45 secured thereto with a downturned flange 46.

The shroud plate 45 and the exterior of the pipe 27 therebelow has a layer of sound absorbing material 47 secured thereto which absorbs the sound caused by air travelling therealong to the space 28. The sound absorbing material can be of any suitable heat resistant durable composition, with a ceramic fiber mat having a thickness of the order of one and one half inches and a density of the order of four pounds per cubic foot, being one of the preferred materials.

The pipe 10 has a shroud 48 connected thereto with an upwardly and outwardly extending frusto-conical wall 49 and cylindrical wall 50 in overlapping relation to the wall 27 and its lining 47. The shroud 49 has a layer of sound absorbing material 51, like the layer 47, secured thereto.

It will be noted that the air supplied to the pipe extension 18 and interior of pipe 12, and the air supplied to the space 28 enters below the shroud 45 and around the top end of the shroud 50, moves downwardly past the lower end of the pipe 27 and its lining before moving upwardly.

One or more pilots 53 supplied with gas for combustion by a pilot gas supply pipe 54 can be provided, with igniters 55 of any desired type.

In use combustible flare gas to be burned is delivered to the pipe 10 and moves upwardly therethrough. The combustible gas has a swirling motion imparted to it by the vanes 24 and the whirling stream is also spread by the outer surface of the outlet section 13.

Concurrently with the advancing movement of the gas, air is induced upwardly within the pipe 12 by steam from the steam nozzle 19 for upwardly delivery, also with a swirling motion imparted to it by the vanes 16 and with a spreading of the stream by the diffuser 14 for intimate contact with and to aid in the combustion of the flare gas.

Also, concurrently with the movement of the flare gas and air just referred to air is also induced upwardly through the passageway 28 and delivered in a hollow stream beyond the upper end of that space being guided in a converging or conical path by converging wall 41 of the guide ring 40. This outer air stream by reason of its direction is in intimate contact with and mixes with the combustible gas for burning.

The steam from the steam nozzles 39, by reason of their positioning at an angle to the vertical and in a chordal relation to the gas and air streams, adds to the whirling action, induces additional air flow into the gas and/or streams from the surrounding atmosphere and creates greater turbulence in the air and gas streams to aid the combustion and to aid in eliminating smoke.

In the event of cut back of combustible gas delivery to very low flow or no flow the diodes 21 prevent back flow of air into the pipe 10 which might with the combustible gas provide an explosive mix therein.

It will be noted that the air passing upwardly within the pipe 12 and within the passageway 28 enters substantially horizontally below the shroud 45, passes vertically downwardly in the space between the lining 51 of the shroud 50 and the lining 47 on the pipe 27 and then is turned upwardly.

The middle frequency combustion noise from the burning gases, and which is dependent on the composition of the gas, the turbulence in the mixing, and the burning is absorbed and attenuated by the linings 47 and 51.

The higher frequency or jet noise from the use of the steam at the nozzles 36 and 39 is directional and hence tends to be directed upwardly but downward noise such as that from the steam delivery orifices 32 is absorbed and attenuated by the linings 47 and 51.

Combustion, because of the effective mixing of the multiple air streams and waste gas, together with the admisture of the steam, is smokeless, and by reason of the provisions for noise suppression will be quiet.

It will thus be seen that structure has been provided with which the objects of the invention are achieved.

I claim:

1. A flare gas burner for combustible waste gas comprising a vertical stack having a plurality of concentric pipes providing spaces for delivery to the upper end of combustible waste gas, steam and induced air for combustion beyond said upper end, an inner of said pipes being effective for air and steam delivery and having members for imparting a whirling motion to said air and steam, an intermediate of said pipes being effective for combustible gas delivery in surrounding relation to the air and steam from said inner pipe, and having members for imparting a whirling motion to said combustible gas, an outer of said pipes being effective for air and steam delivery, means associated with said outer pipe for converging said delivered air and steam toward said combustible waste gas stream, and additional steam supply members for directing steam into contact with the rising whirling stream of gas and air.

2. A flare gas burner as defined in claim 1 having means for reducing transmission of noise resulting from the induction of the air through said inner and outer pipes, said means comprising sound absorbing members contiguous to and in advance of the air inlets to said inner and outer pipes.

3. A flare gas burner as defined in claim 1 in which the inner of said pipes has an air diffuser carried thereby for diverging flow of said air.

4. A flare gas burner as defined in claim 1 in which said inner pipe has an upwardly directed steam discharge member therein for inducing upward flow of air in said inner pipe.

5. A flare gas burner as defined in claim 1 in which said outer pipe has upwardly directing steam discharge members at the entrance thereof for inducing upward flow of air in said outer pipe.

6. A flare gas burner as defined in claim 1 in which said outer pipe has upwardly and inclined steam discharge members for imparting a whirling motion to the air delivered from said pipe.

7. A flare gas burner as defined in claim 1 in which said additional steam supply members comprise inclined nozzles.

8. A flare gas burner as defined in claim 2 in which said means for reducing transmission of noise comprises spaced upper and lower shrouds surrounding said pipes and on which said sound absorbing members are mounted, and said shrouds are disposed to provide a tortuous path for air for delivery by said inner and outer pipes.

9. A flare gas burner as defined in claim 1 in which said intermediate pipe is provided with diodes providing obstructions to downflow in said intermediate pipe.

* * * * *

UNITED STATES PATENT OFFICE

CERTIFICATE OF CORRECTION

Patent No. 3,994,671 Dated November 30, 1976

Inventor(s) John F. Straitz, III

It is certified that error appears in the above-identified patent and that said Letters Patent are hereby corrected as shown below:

Column 3

Line 54, after "shroud", change "49" to - 48 -.

Signed and Sealed this

Fifteenth Day of February 1977

[SEAL]

*Attest:*

RUTH C. MASON
*Attesting Officer*

C. MARSHALL DANN
*Commissioner of Patents and Trademarks*